United States Patent [19]

Mowli et al.

[11] 4,126,085

[45] Nov. 21, 1978

[54] METHOD OF PRODUCING A RECLOSABLE BAG

[76] Inventors: John C. Mowli, 2032 W. Jarvis, Chicago, Ill. 60645; Harry Bala, 2259 N. Kedzie, Chicago, Ill. 60647

[21] Appl. No.: 770,602

[22] Filed: Feb. 22, 1977

[51] Int. Cl.[2] ..... B31B 49/04; B31B 1/90

[52] U.S. Cl. ..... 93/35 R

[58] Field of Search ..... 93/35 DS, 35 R, 33 H, 93/33 R, 8 R, 8 WA, 8 VB, 14, 17-20; 229/65

[56] References Cited

U.S. PATENT DOCUMENTS

| | | | |
|---|---|---|---|
| 3,354,795 | 11/1967 | Kugler | 93/8 WA |
| 3,418,891 | 12/1968 | Rivman et al. | 93/35 R |
| 3,859,895 | 1/1975 | White | 93/35 DS |
| 3,889,871 | 6/1975 | White | 93/8 WA X |

FOREIGN PATENT DOCUMENTS

| | | | |
|---|---|---|---|
| 2,302,349 | 7/1973 | Fed. Rep. of Germany | 229/65 |

*Primary Examiner*—James F. Coan
*Attorney, Agent, or Firm*—George H. Gerstman

[57] ABSTRACT

A flexible closure strip capable of being bent manually and retaining the bent shape is interposed between the front ply and the back ply of a thermoplastic bag. The front and back plies are heat sealed to each other to form a pocket in which the stiffener strip is located and a bag mouth is formed under the heat seal.

8 Claims, 8 Drawing Figures

FIG. 1
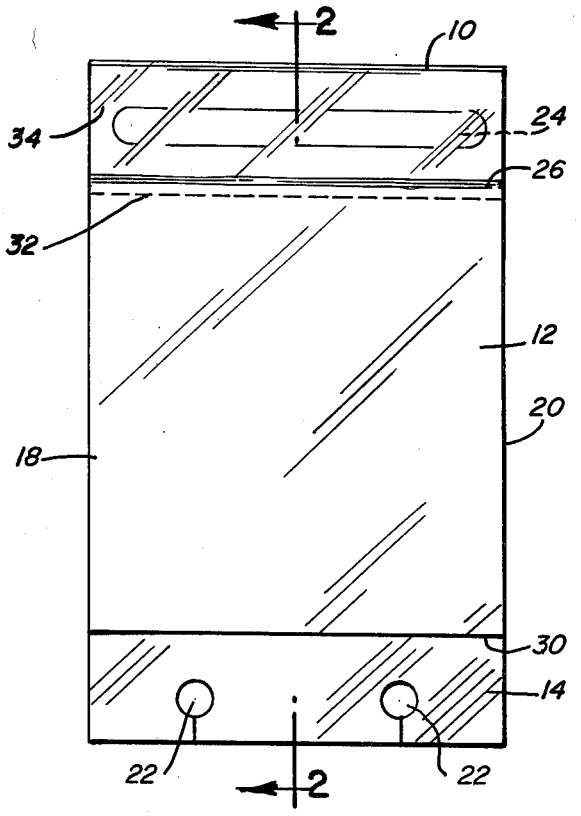
FIG. 2
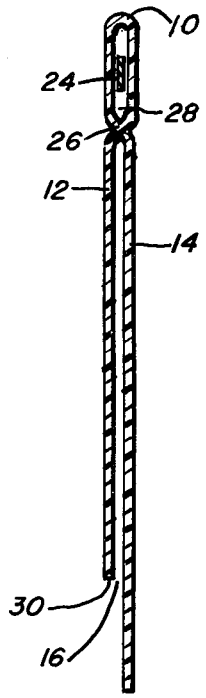
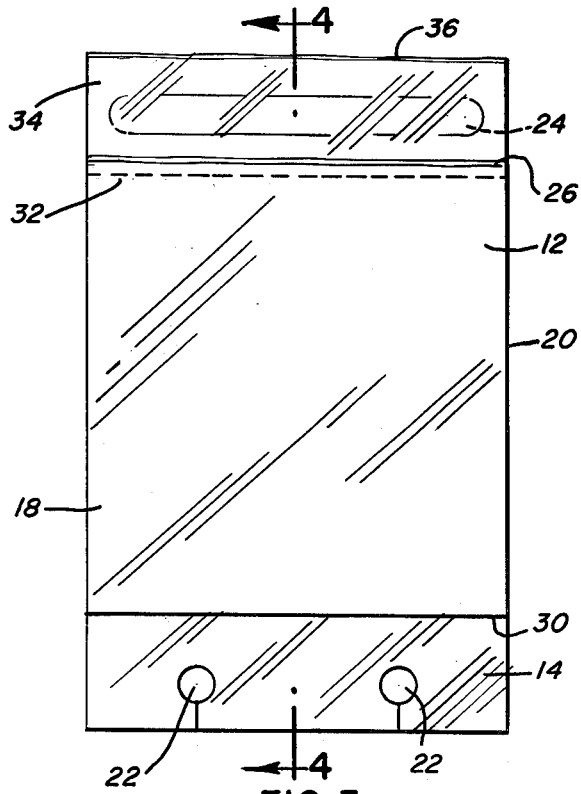
FIG. 3
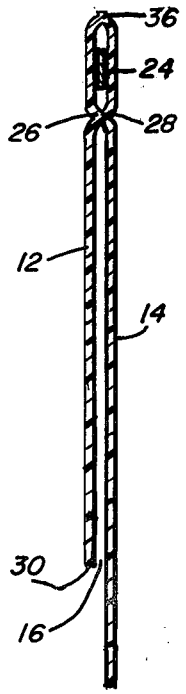
FIG. 4

FIG. 5
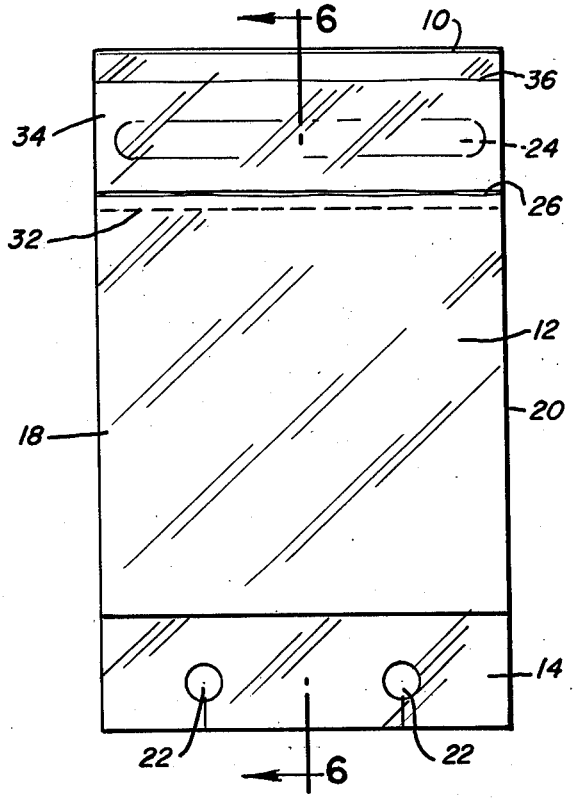
FIG.6
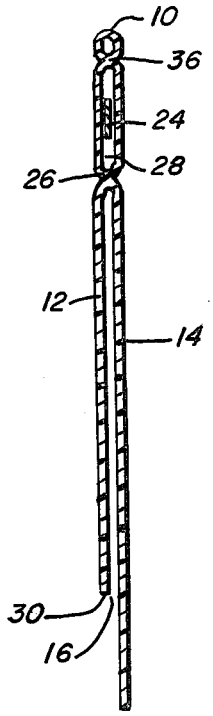
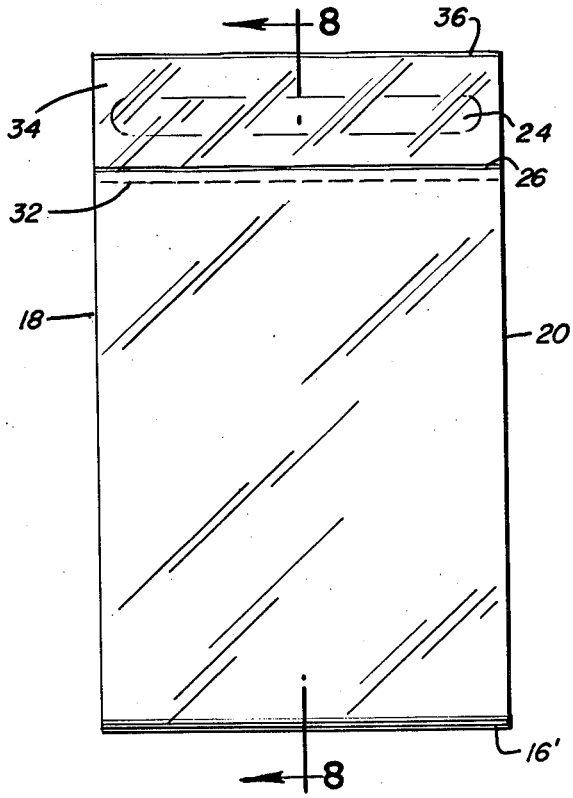
FIG. 7
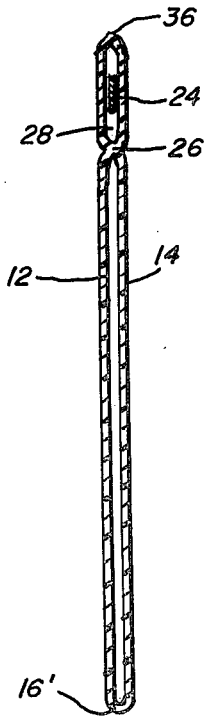
FIG. 8

METHOD OF PRODUCING A RECLOSABLE BAG

BACKGROUND OF THE INVENTION

This invention relates to a novel reclosable container which is inexpensive to manufacture and easy to use.

An increasing number of articles are packaged in plastic bags. In addition, rolls of plastic bags are presently sold for consumer use in packaging household items or the like. It is often desirable to have the ability to remove at least part of the bag's contents and reclose the bag thereafter. However, various disadvantages have been found with prior art reclosable bags.

For example, one type of recloseable bag is disclosed in Ruda U.S. Pat. No. 3,759,438. In the Ruda construction, a stiffener is located inside the mouth of the bag, which provides a construction that is relatively difficult to manufacture. In the Ruda construction, in order to heat seal the stiffener special equipment is required having an insulative device between the plies of the bag, so that the front and back plies of the bag will not become heat sealed to each other. Thus in producing Ruda's reclosable bag, it is advantageous to heat seal the stiffener prior to heat sealing the sides of the bag. At that time, the front and back piles of the bag are not adjacent each other and the stiffener may be heat sealed without heat sealing the front and back plies of the bag to each other. In any event, in manufacturing the Ruda reclosable bag at least two separate heat sealing steps are required using two different machine operations. Additionally, by using a stiffener which has a length substantially less than the width of the bag, a continuous flow operation is difficult. In such cases, an intermittent break off is required, thereby preventing a continuous operation.

The prior art patent to White, U.S. Pat. No. 3,889,871, discloses another type of reclosable bag in which a separate tape is required to connect the stiffener to the bag. The requirement of a separate fastening means is deleterious to optimum manufacture.

Another type of alleged reclosable bag construction is disclosed in Hoeppner, et al. U.S. Pat. No. 2,620,842, in which a flap overlies the front wall and mouth of the bag, to provide a handle and closure means. However, the security of the Hoeppner, et al. bag is questionable because there is no tie or stiffener to provide a repeatable secure closure.

The prior art patents to Rivman, et al., U.S. Pat. No. 3,321,126 and Chesney U.S. Pat. No. 587,928, show other prior art reclosable containers. In the Rivman, et al. patent, an external strip is required to be fastened over a wire stiffener. This has the disadvantage mentioned above in connection with White U.S. Pat. No. 3,889,871. Chesney discloses a paper container in which a stiffener is fastened below the mouth of the bag, so that the mouth of the bag becomes rolled about with the stiffener being bent to close the roll. In the Chesney construction, an external fastening strip is needed to fasten the stiffener to the bag.

It is an object of the present invention to provide a plastic bag that overcomes many of the disadvantages of prior art plastic bags. To this end, one of the objects of the present invention is to provide a bag which is efficient to manufacture and simple in operation.

Another object of the present invention is to provide a plastic bag using a closure strip, with the closure strip being located above the mouth of the bag for ease in operation.

A further object of the present invention is to provide a plastic bag construction in which the bag is heat sealed to contain a closure strip, with the heat seal being accomplished either before, after or during heat sealing the sides of the bag.

A still further object of the present invention is to provide a reclosable bag in which the closure strip is heat sealed to the bag using efficient production techniques.

Other objects and advantages of the present invention will become apparent as the description proceeds.

SUMMARY OF THE INVENTION

In accordance with the present invention, there is provided a plastic bag of heat sealable film-type material and including a front ply and a back ply. A flexible closure strip capable of being bent manually and retaining the bent shape is interposed between the front ply and the back ply. The front ply is bonded to the back ply by a heat seal forming a pocket in which the closure strip is located. A bag mouth is formed under the heat seal.

In the illustrative embodiment, the heat seal is transverse the width of the bag and is located both above and under the closure strip. The bag mouth is formed closely adjacent the heat seal and extends transverse substantially the entire width of the bag.

A more detailed explanation of the invention is provided in the following description and claims, and is illustrated in the accompanying drawings.

BRIEF DESCRIPTION OF THE DRAWINGS

FIG. 1 is a front view of a reclosable bag constructed in accordance with the principles of the present invention;

FIG. 2 is a cross-sectional view thereof, taken along the plane of the line 2—2 of FIG. 1;

FIG. 3 is a front view of a reclosable bag constructed in accordance with the second embodiment of the present invention;

FIG. 4 is a cross-sectional view thereof, taken along the plane of the line 4—4 of FIG. 3;

FIG. 5 is a front view of a reclosable bag constructed in accordance with a third embodiment of the present invention;

FIG. 6 is a cross-sectional view thereof, taken along the plane of the line 6—6 of FIG. 5;

FIG. 7 is a front view of a reclosable bag constructed in accordance with a fourth embodiment of the present invention; and FIG. 8 is a cross-sectional view thereof, taken along the plane of the line 8—8 of FIG. 7.

DETAILED DESCRIPTION OF THE ILLUSTRATIVE EMBODIMENT

Referring to FIGS. 1 and 2, a reclosable plastic bag is shown therein, in which a sheet of thermoplastic material is folded at the top 10 to form a front ply 12 and a back ply 14, with an open bottom 16. Sides 18, 20 are heat sealed. A pair of circular openings 22 are defined by rear ply 14 for aid in automatically loading the product inside the bag.

A closure strip 24 capable of being bent manually and retaining its bent shape is positioned between front ply 12 and back ply 14 and a heat seal 26 is applied to both plies to seal the front and back plies and form a pocket 28 in which closure strip 24 is carried. Sides 18, 20 may be heat sealed before, simultaneously with or after heat seal 26 is formed.

Closure strip 24 may be formed of sheet metal, paper enclosed wire, or any material which is flexible yet when bent manually tends to retain its bent shape.

In the typical use of the bag of FIGS. 1 and 2, the customer may be a commercial or industrial customer and may load the bag from the bottom 16, using automatic equipment which is coupled to openings 22. Once the bag is loaded, a heat seal cutoff is provided parallel to and slightly above bottom 30 of front ply 12. Prior thereto, or simultaneously therewith, or subsequent thereto, a score line 32 may be provided for forming a bag mouth. The purchaser receiving the bag with the articles therein may remove a portion of the articles via the slit resulting from score line 32. The bag can be reclosed by folding over top portion 34 and then bending closure strip 24.

The bag illustrated in FIGS. 1 and 2 is extremely easy and inexpensive to produce, and in the illustrative embodiment requires a transverse heat seal at 26, side heat seals along 18 and 20 and a transverse heat seal-cut slightly above bottom 30 of front ply 12 and parallel thereto. If desired, score line 32 may be an open slit and the bag may be sold with top portion 34 already folded over with the closure strip 24 bent.

In the other embodiments, identical reference numerals are used to designate corresponding portions. Thus referring now to FIGS. 3 and 4, the bag shown therein is similar to the bag of FIGS. 1 and 2, except that instead of the bag being formed by a fold-over at the top, the bag is formed by two separate plies 12 and 14 which are heat sealed at the top 36, in addition to the other heat seals discussed in connection with the embodiments of FIGS. 1 and 2. Thus heat seal 36 is formed by a heat seal cutoff device, and there is no folding operation required.

Referring now to the embodiment of FIGS. 5 and 6, this embodiment is also similar to the embodiment of FIGS. 1–4, but it includes both a top formed from a folded-over portion 10 and an upper heat seal 36 defining the top of the pocket 28. In other respects, however, the description of the bag illustrated in FIGS. 5 and 6 is the same as the description of the bags illustrated in FIGS 1–4.

The reclosable bag illustrated in FIGS. 7 and 8 is formed by folding a sheet of thermoplastic material at the bottom 16', inserting closure strip 24 between the front ply 12 and back ply 14 at the top thereof, and providing a heat seal 36 at the top and another heat seal 26 below the closure strip 24 to define a pocket 28 in which the stiffener strip 24 is located. As with the bags illustrated in FIGS. 1–6, sides 18 and 20 are also heat sealed and a score line, or slit 32, is provided. In the FIGS. 7 and 8 embodiment, the articles are inserted into the bag via slit 32 and the bag is closed by folding over top portion 34 and bending closure strip 24.

It is to be understood that the pocket 28 shown in the drawings is for illustrative purposes only and, in actuality, the pocket volume would only be very slightly greater than that required to enclose the closure strip 24. Further, closure strip 24 may extend laterally outside of the bag, if desired. Still further, the heat seals may be wide and may cover substantially the entire top portion 34. Additionally, the bag may be formed from tubular extruded plastic sheet material by interposing closure strip 24 between a front and back ply and thereafter heat sealing the system to form a pocket enclosing the closure strip.

Thus in each embodiment, the closure strip may be tightly enclosed by the heat sealed portions, or the closure strip may be loose or slidable within the pocket 28 formed by the heat seal. If secure fastening of the closure strip 24 is essential, the closure strip may define openings to permit the heat sealing through the closure strip. The ends 18, 20 of the pocket 28 may be left unheat sealed, to permit the closure strip to slide out of or be inserted into the pocket. As mentioned above, the closure strip may be longer, or shorter or the same length as the pocket.

It is seen that illustrative embodiments of the invention have been shown and described, but various modifications and substitutions may be made by those skilled in the art without departing from the novel spirit and scope of the present invention.

What is claimed is:

1. A method of producing a reclosable bag comprising the steps of:

cutting an extruded tubular double-ply sheet of thermoplastic material to the size of a reclosable bag, with the bag having a front ply and a back ply;

interposing between said front and back plies a metallic closure strip capable of being bent manually and retaining the bent shape;

without attaching said closure strip to said plies applying a heated die across said front ply and back ply to form a heat sealed pocket in which said closure strip is located, the heated die being applied across the width of the plies whereby the sides of the heat sealed pocket resulting therefrom are open; and thereafter closing the sides of the bag by heat sealing along the length of the plies other than the pocket whereby the pocket sides remain open.

2. A method of producing a reclosable bag as described in claim 1, wherein said heated die is applied above and below said closure strip to form said heat sealed pocket.

3. A method of producing a reclosable bag which comprises the steps of:

folding a sheet of thermoplastic material to form a front ply and a back ply;

interposing between said front ply and said back ply a metallic closure strip capable of being bent manually and retaining the bent shape;

without attaching said closure strip to the plies applying a heated die across said front ply and back ply to form a heat sealed pocket in which said closure strip is located, the heated die being applied across the width of the plies whereby the sides of the heat sealed pocket resulting therefrom are open; and thereafter closing sides of the bag by heat sealing along the length of the plies other than the pocket whereby the pocket sides remain open.

4. A method of producing a reclosable bag as described in claim 3, wherein said heated die is applied above and below said closure strip to form said heat sealed pocket.

5. A method of producing a reclosable bag as described in claim 3, wherein a fold is formed at the bottom of the bag and said heated die is applied above and below said closure strip.

6. A method of producing a reclosable bag as described in claim 3, including the step of cutting a transverse slit substantially across the width of said front ply to form a bag mouth.

7. A method of producing a reclosable bag as described in claim 3, wherein a fold is formed at the top of the bag and the bottom of the bag is open for receiving an article.

8. A method of producing a reclosable bag as described in claim 3, wherein a fold is formed at the top of the bag and said heated die is applied below said closure strip.

* * * * *